US011634199B2

(12) United States Patent
Reynard et al.

(10) Patent No.: US 11,634,199 B2
(45) Date of Patent: Apr. 25, 2023

(54) HULL DEVICE

(71) Applicant: NAVAL GROUP, Paris (FR)

(72) Inventors: François Reynard, Ollioules (FR); Didier Cavallera, Ollioules (FR); Laurent Demilier, Brest (FR)

(73) Assignee: NAVAL GROUP, Paris (FR)

( * ) Notice: Subject to any disclaimer, the term of this patent is extended or adjusted under 35 U.S.C. 154(b) by 9 days.

(21) Appl. No.: 16/765,244

(22) PCT Filed: Nov. 19, 2018

(86) PCT No.: PCT/EP2018/081786
§ 371 (c)(1),
(2) Date: May 19, 2020

(87) PCT Pub. No.: WO2019/097056
PCT Pub. Date: May 23, 2019

(65) Prior Publication Data

US 2020/0283107 A1 Sep. 10, 2020

(30) Foreign Application Priority Data

Nov. 20, 2017 (FR) ..... 17 01196

(51) Int. Cl.
*B63G 8/04* (2006.01)
*B63G 8/34* (2006.01)

(52) U.S. Cl.
CPC . *B63G 8/04* (2013.01); *B63G 8/34* (2013.01)

(58) Field of Classification Search
CPC ... B63B 59/08; B63B 59/10; B63B 2005/245; B63B 2231/30; B63G 13/02; B63G 8/28; B63G 8/34; B63G 8/04
See application file for complete search history.

(56) References Cited

U.S. PATENT DOCUMENTS 5,038,701 A * 8/1991 Riddell ..... B63B 43/16 114/227
2002/0170481 A1 11/2002 McNamara et al.
2009/0260556 A1* 10/2009 Sahr ..... B63B 3/48 114/85
2012/0255152 A1 10/2012 Evans
(Continued)

FOREIGN PATENT DOCUMENTS

FR 2 568 401 1/1986
GB 2 510 087 7/2014
(Continued)

OTHER PUBLICATIONS

Nautical Expo "Polypropylene floor coverings" https://www.nauticexpo.com/boat-manufacturer/polypropylene-floor-covering-38122.html, published Aug. 11, 2017, retrieved Sep. 22, 2021 (Year: 2017).*
(Continued)

*Primary Examiner* — Andrew Polay
(74) *Attorney, Agent, or Firm* — Nixon & Vanderhye

(57) ABSTRACT

Disclosed is a hull device designed to be reversibly attached to an outer surface of a ferromagnetic structure of a marine or submarine system or vessel. The device includes at least one attachment surface suitable for attaching the device to the structure, and a plurality of permanent magnets arranged in the vicinity of the attachment surface in order to attach the device to the structure.

13 Claims, 5 Drawing Sheets

(56) References Cited

U.S. PATENT DOCUMENTS

| | | | | |
|---|---|---|---|---|
| 2014/0077587 | A1* | 3/2014 | Smith | B63B 71/00 305/15 |
| 2014/0103169 | A1 | 4/2014 | Heard et al. | |
| 2014/0230711 | A1 | 8/2014 | Lovelace et al. | |
| 2017/0323715 | A1* | 11/2017 | Chewins | B63B 43/16 |
| 2019/0185119 | A1* | 6/2019 | Urrang | B62D 55/065 |

FOREIGN PATENT DOCUMENTS

| | | | |
|---|---|---|---|
| GB | 2514626 | A | 12/2014 |
| JP | S59-122509 | U | 8/1984 |
| JP | H06-504019 | A | 5/1994 |
| JP | 2013-177112 | A | 9/2013 |
| JP | 2016-196284 | A | 11/2016 |
| WO | 92/04574 | A1 | 3/1992 |
| WO | 2010/078299 | A1 | 7/2010 |

OTHER PUBLICATIONS

Kand J Blog "Halbach Arrays" https://www.kjmagnetics.com/blog.asp?p=halbach-arrays, published Nov. 27, 2016, retrieved Sep. 22, 2021 (Year: 2016).*

International Search Report, PCT/EP2018/081786, dated Jan. 15, 2019.

French Search Report, FR 1701196, dated Jul. 3, 2018.

* cited by examiner

HULL DEVICE

BACKGROUND OF THE INVENTION

Field of the Invention

The present invention relates to a hull device suitable for being reversibly fastened on an outer surface of a structure made from a ferromagnetic material of a vessel or a marine or submarine system, the device comprising at least one attachment surface able to allow the attachment of the device to the structure.

The invention also relates to a vessel or a marine or submarine system provided with such a device.

Description of the Related Art

In the naval industry, it is desirable to attach devices on the hull of a vessel simply and, if possible, reversibly. This is for example a hull coating contributing desirable properties to the vessel, for example an improvement to its acoustic or radar stealth.

This is in particular the case regarding submarine vessels, since it is common to cover the hull thereof with a technical coating.

The attachment of these coatings is generally done by gluing, which allows a quick and easy installation, while remaining inexpensive in terms of material and qualified personnel.

These coatings must, however, be removed, in order to be replaced or to access the hull for upkeep thereof. A reversible attachment is therefore desirable, to facilitate the removal of the coating, and optionally to be able to reuse it once the operation requiring the removal is complete.

The reversible attachment systems are also useful for hull devices other than coatings, such as sensors and cameras. These may also be mobile devices such as robots, hull inspection apparatuses or devices that use the reversible aspect of the attachment during their movement.

It is known to attach the devices reversibly using threaded dowels screwed into slugs previously welded to the hull of the vessel, which crush the coating on the hull.

The aforementioned reversible fastening systems are not fully satisfactory. Indeed, fastening by screwing requires welding a large number of slugs on the hull, which is time-consuming and expensive in terms of material and qualified labor.

SUMMARY OF THE INVENTION

One aim of the invention is to provide a reversibly attachable hull device, the installation of which is easy and inexpensive in terms of specific equipment and labor.

To that end, the invention relates to a hull device of the aforementioned type, characterized in that the device includes a plurality of permanent magnets arranged in the vicinity of the attachment surface in order to attach the device to the structure.

The attachment of such a device with a ferromagnetic structure is simple and does not require specific equipment or qualified personnel. The device is kept against the structure by the permanent magnets during the use of the marine or submarine vessel, and can be removed easily during maintenance or replacement operations. Such a system is more compact, simple and robust, as well as inoffensive for the support. It also does not require an energy supply, and lastly is not very sensitive to aging.

According to specific embodiments, the hull device according to the invention includes one or more of the following features, considered alone or according to any technically possible combination(s):

- the magnets are positioned in a grid on the attachment surface, each magnet being adjacent to or in the vicinity of at least one closest neighbor, each magnet having a polarity, the polarity of each magnet being oriented in the direction opposite the polarity of its at least one closest neighbor;
- the grid forms a checkerboard, each magnet being adjacent to between one and four closest neighbors;
- the device comprises a tile of elastomer material intended to form a coating for at least part of the hull;
- the magnets are embedded in the tile in the vicinity of the attachment surface, or flush with the attachment surface;
- the attachment surface includes an inner region extending away from the edges of the tile and a peripheral region surrounding the inner region and extending near the edges of the tile, the magnets being positioned on at least part of the peripheral region of the attachment surface, the inner region of the attachment surface being devoid of magnets;
- the tile has at least one beveled edge suitable for cooperating with a nonslip rib extending over the outer surface of the hull;
- the device comprises at least one wheel, at least one moving foot, or at least one track, the attachment surface extending over a trend of the wheel or the track or below the moving foot, the device being able to move along the outer surface of the hull while being kept in contact with the hull by the magnets of the attachment surface; and
- the device comprises a magnetic plate, able to be positioned in the vicinity of the structure, the attachment structure extending over the magnetic plate, the device also comprising at least one wheel, at least one track or at least one foot suitable for moving the device relative to the structure, the wheel, the track or the foot not being magnetic.

The invention also relates to a marine or submarine vessel or structure provided with a hull device as described above, the device being reversibly attached on an outer surface of a structure of the vessel or system, the attachment surface being positioned in the vicinity of the structure, the attachment of the device to the structure being done by a plurality of magnets.

BRIEF DESCRIPTION OF THE DRAWINGS

The invention will be better understood upon reading the following description, provided solely as example and in reference to the accompanying drawings, in which.

DESCRIPTION OF THE PREFERRED EMBODIMENTS

Figure 1:
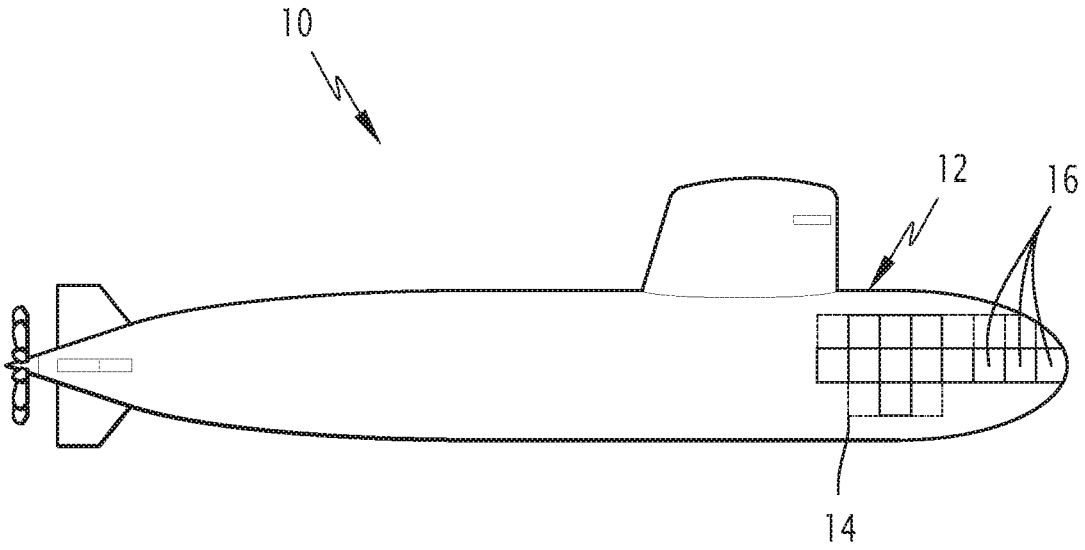
FIG. 1 is a side view of a submarine vessel comprising devices according to the invention.

A submarine vessel 10 is shown in FIG. 1. The submarine vessel 10 comprises a hull 12 made from ferromagnetic material, defining an outer surface 14 and tightly separating an inner space from an outer space of the submarine vessel 10, even under the effect of outside pressures.

Multiple hull devices are attached on the outer surface 14 of the hull 12. The hull devices are attached to the outer surface 14 reversibly, that is to say, it is possible to remove them from the outer surface 14 without damaging them, or damaging the hull 12.

In particular, it is possible to reassemble the hull devices on the hull 12 after having removed them, without having to change them in the meanwhile to be able to perform the reassembly.

According to a first embodiment shown in FIGS. 1 to 4, the hull devices are tiles 16 forming a coating of part of the hull 12 in order to modify at least one property of the outer surface 14.

For example, the tiles 16 are made from an elastomer material having advantageous properties of absorbing acoustic vibrations, and form an anechoic coating of the hull 12.

The outer surface 14 then has greatly reduced properties of reflecting acoustic waves, and in particular sonar waves, which increases the stealth of the submarine vessel 10.

The tiles 16 for example have a parallelepiped shape, with a rectangular or square base. The base in this case is the face of the tile 16 facing the hull 12.

Figure 2:
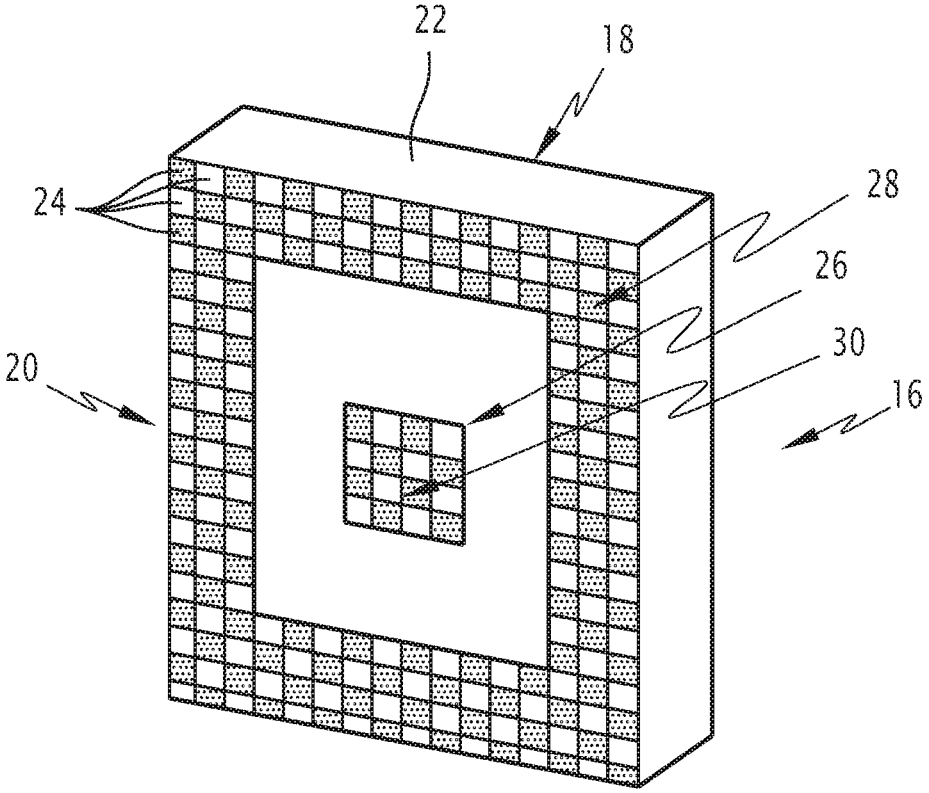
FIG. 2 is a perspective view of one of the devices of FIG. 1.

As shown in FIG. 2, the tile 16 has an outer side 18 and an attachment side 20, extending on either side of the tile 16, as well as side edges 22.

The tile 16 includes a plurality of permanent magnets 24 attaching this tile 16 to the hull 12, placed in the vicinity of the attachment surface 20. The magnets 24 are for example embedded in the tile 16, in the vicinity of the attachment surface 20, or flush with the attachment surface 20.

The magnets 24 are for example magnets comprising neodymium, for example neodymium/iron/boron, having a rectangular or disc shape.

Advantageously, the magnets 24 are small, each magnet 24 having a relatively low individual adherence strength relative to the total adherence strength of the set of magnets 24. It is then the multiplicity of magnets 24 that makes it possible to provide good adhesion of the hull device on the hull 12.

According to the embodiment of FIG. 2, the attachment surface 20 includes an inner region 26 extending away from the edges 22, and a peripheral region 28 surrounding the inner region 26 and extending near the edges 22, and a central region 30 extending in the middle of the attachment surface 20, surrounded by the inner region 26.

The magnets 24 are placed on the peripheral region 28 and the central region 30, the inner region 26 being devoid of magnets 24.

This arrangement makes it possible to maximize the holding power of the tile 16, the stresses resulting from pulling out of the tile 16 being located in the vicinity of the edges 22.

The magnets 24 are arranged in a grid over the attachment surface 24, for example a grid forming a checkerboard.

Each magnet 24 is thus adjacent to at least one closest neighbor, for example to between one and four closest neighbors in the case of a checkerboard grid.

"Adjacent" means that the magnets 24 are in contact by one respective lateral edge, or that their respective adjacent lateral edges are next to one another.

Figure 3:
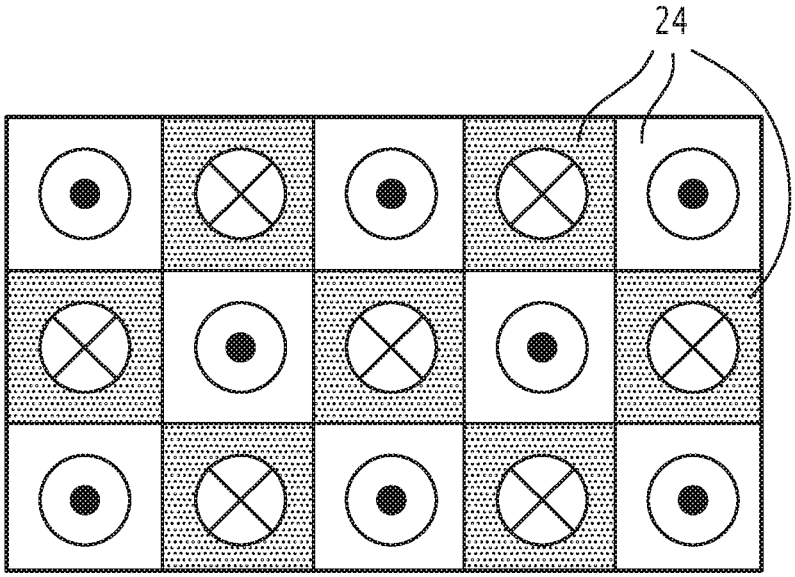
FIG. 3 is a rear view of a detail of the device of FIG. 2.

As shown in FIG. 3, each magnet 24 has a polarity oriented in a direction substantially orthogonal to the attachment surface 20.

Each of the closest neighbors of the magnet 24 has a polarity oriented in the direction opposite the polarity of the magnet 24.

By convention, in the figures, the magnets 24 whereof the polarity is oriented toward the hull 12 are shown in white, and the magnets 24 whereof the polarity is oriented toward the outside are shown in gray.

Thus, the proportion of magnets 24 whereof the polarity is oriented in one direction and the proportion of magnets 24 whereof the polarity is oriented in the opposite direction are substantially equal, advantageously equal.

According to one variant, the material of the tiles 16 has advantageous properties of thermal insulation, absorption of electromagnetic waves, reduction of the hydrodynamic drag, or the like.

According to one variant, the tiles 16 have a prism shape with a hexagonal base, which increases the holding power of the tile 16. More generally, the shape of the base may have any geometry making it possible to ensure a desired coverage of the outer surface 14 of the hull 12.

According to one variant, the magnets 24 are embedded in the tile in the vicinity of the attachment surface 20, for example at a distance of less than 5 mm from the attachment surface 20.

According to one variant, the magnets 24 are glued on the tile 16 at the attachment surface 20.

According to one variant, the magnets 24 are groups of permanent magnets in contact with or close to one another, having polarities oriented in a same direction, the groups of magnets being arranged in a grid identically to the magnets 24 described above.

According to one variant, the magnets 24 are arranged in a disorderly manner on the attachment surface 20, the proportion of magnets 24 whereof the polarity is oriented in one direction being substantially equal to the proportion of magnets 24 whereof the polarity is oriented in the opposite direction.

According to one variant, the central region 30 is devoid of magnets 24, the magnets 24 being positioned on the peripheral region 26 only.

According to one variant, the magnets 24 are positioned on the entire attachment surface 20.

According to one variant, the polarities of the magnets form a non-right angle with the attachment surface 20, or are tangential to the attachment surface 20.

According to one variant, the magnets 24 are not adjacent to their closest neighbors, but are separated by a constant pitch from each of their closest neighbors.

Figure 4:
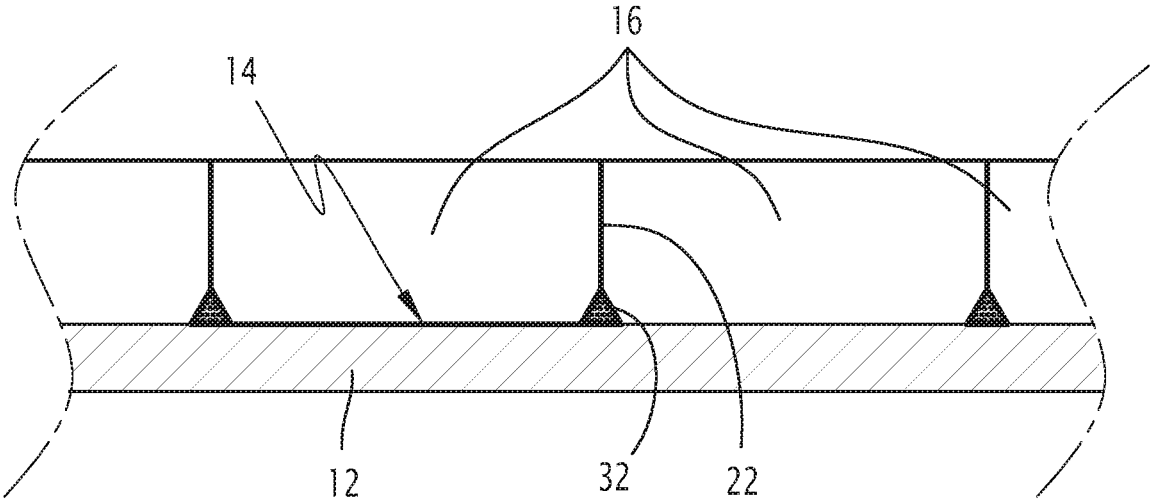
FIG. 4 is a sectional view of three devices according to a second embodiment of the invention.

According to one variant shown in FIG. 4, the edges 22 of each tile 16 are beveled and suitable for cooperating with nonslip ribs 32 extending over the outer surface 14 of the hull 12. This makes it possible to increase the resistance of the tiles 16 to slipping along the outer surface 14 of the hull 12.

Figure 5:
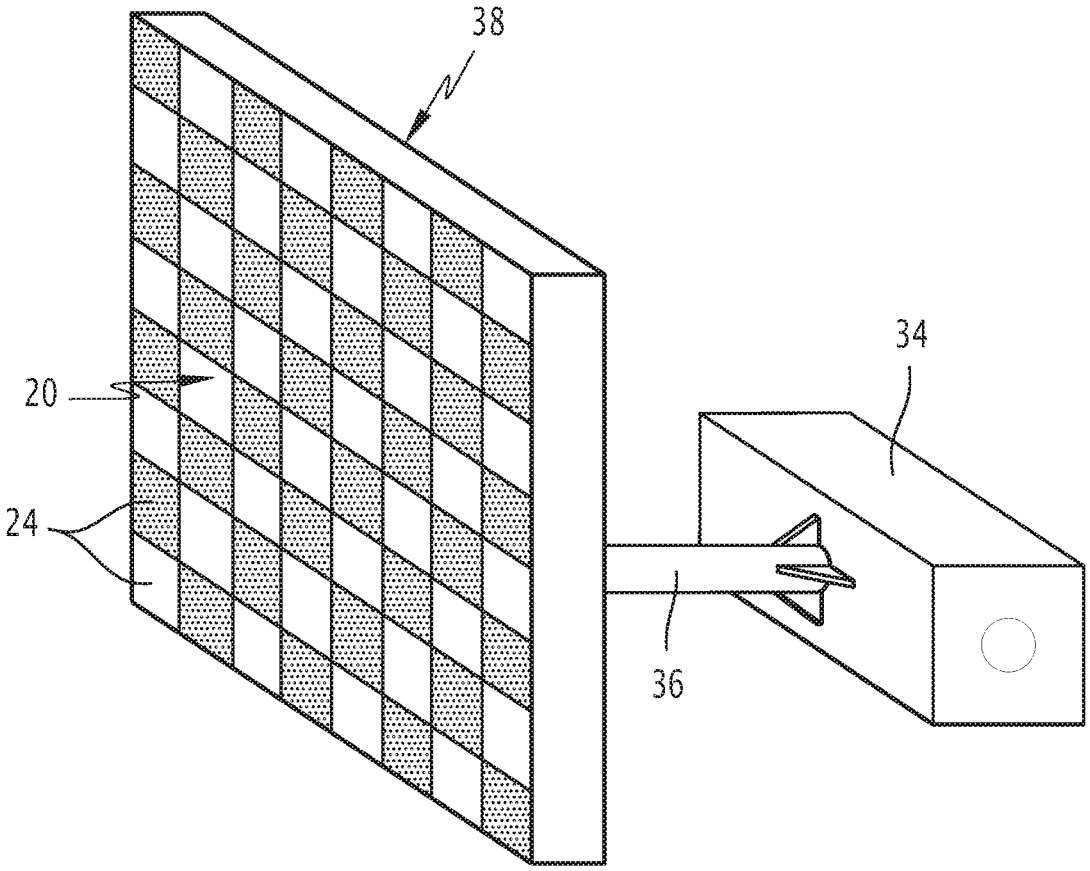
FIG. 5 is a perspective view of a device according to a third embodiment of the invention.

According to a second embodiment shown in FIG. 5, the hull device includes an active apparatus, for example a sprayer 34, and an attachment slab 38.

The sprayer 34 is mounted by means of a foot 36 on the attachment slab 38. The slab 38 defines an attachment surface 20, extending on one side of the slab 38 opposite the foot 36, and including the magnets 24 arranged in a grid as previously described.

In a variant, the active equipment is for example a sensor, a camera, an antenna, a signal apparatus or a tool.

Figure 6:
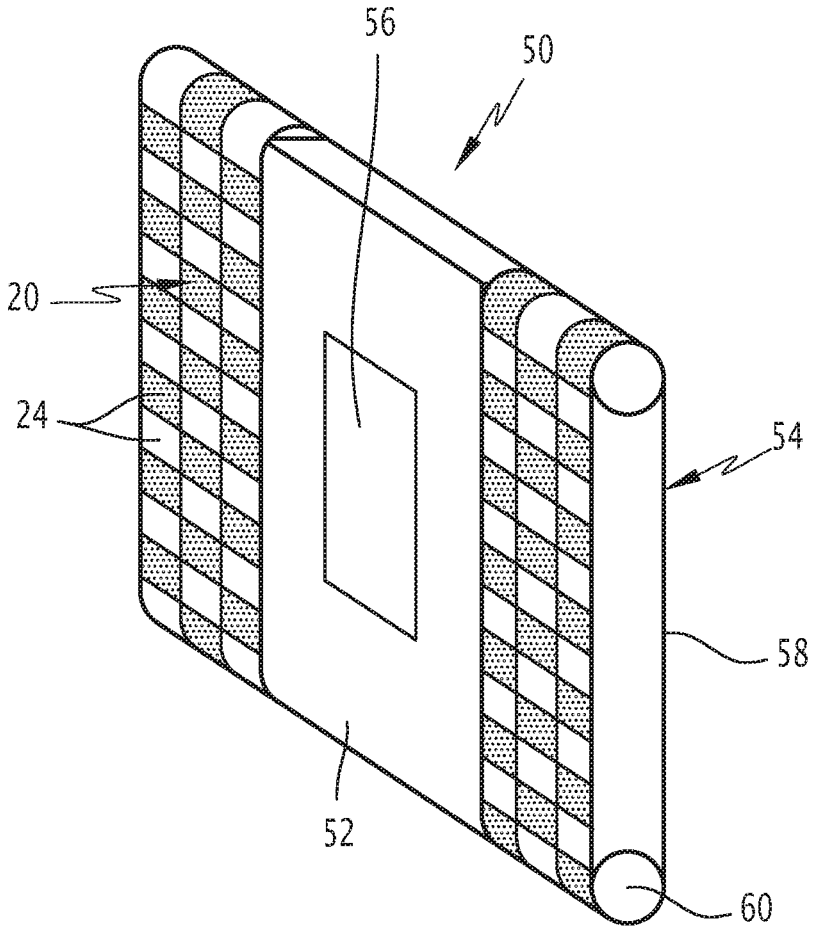
FIG. 6 is a perspective view of a device according to a fourth embodiment of the invention.

According to a third embodiment shown in FIG. 6, the hull device is a mobile device, for example a robot 50 for inspecting the hull 12.

The robot 50 comprises a housing 52 and tracks 54.

The housing 52 contains control electronics of the robot 50, a drive motor of the tracks 54, and communication means. The hull 52 is suitable for tightly insulating its contents from the outside, and includes a window 56 through which the sensors can take measurements, for example optical measurements.

Each track 54 comprises a tread 58 positioned around at least two wheels 60. The wheels 60 are set in rotation by the motor and drive the tread 58, which is in contact with the outer surface 14 of the hull 12.

The attachment surface 20 extends over the tread 58, such that part of the attachment surface 20 is constantly in contact with the outer surface 14 of the hull 12. The magnets 24 are embedded in the tread 58 and flush with the surface of the tread 58.

In a variant, the magnets 24 are glued to the surface of the tread 58.

The magnets 24 located on the part of the attachment surface 20 in contact with the hull 12 then keep the robot 50 against the hull 12 during the movement of the robot 50.

In a variant, the robot 50 comprises wheels or movable feet in place of the tracks 58, and the attachment surface 20 extends over an outer rolling surface of each wheel or below the movable feet.

Figure 7:
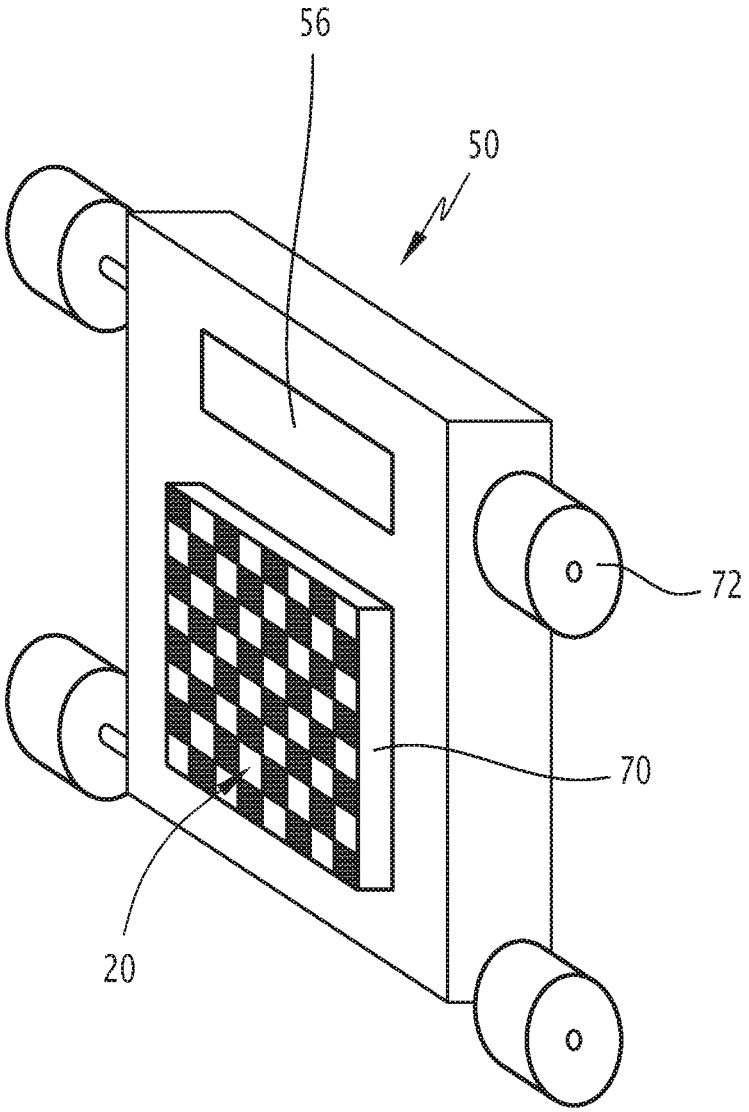

In a variant shown in FIG. 7, the robot 50 comprises a magnetized plate 70 on which the attachment surface 20 extends, located below the robot 50, attaching the robot 50 to the hull 12, as well as non-magnetized wheels 72 moving it. In this case, the magnetized plate 70 is not in direct contact with the hull 12, but is positioned in the vicinity of the hull 12, for example at a distance of less than 2 mm.

The magnetized plate 70 then has an air gap with the hull 12. The contact between the robot 50 and the hull 12 takes place via the wheels 72, or via tracks or feet that are not magnetized, which ensures the movement of the robot 50.

The described hull device can be attached reversibly, and it is easy and inexpensive to install in terms of specific equipment and labor, since the attachment is done by magnets that are easy for one skilled in the art to manipulate.

Additionally, the hull device according to the invention is particularly advantageous in terms of magnetic signature. Indeed, the alternating polarities of the magnets has the advantage both of generating a significant attraction force and minimizing the gradient of the magnetic field lines in the hull. The magnetization of the hull is modified on the surface and at several millimeters thick (in its depth), but much less significantly than a system including large magnets having or not having alternating polarities.

The magnetization of the hull is modified very locally and on the surface, which leads to a very slight modification of the magnetic field several centimeters away from the hull, but does not modify the magnetic field at greater distances.

The invention claimed is:

1. A hull device suitable for being reversibly fastened on an outer surface of a hull made from a ferromagnetic material of a marine vessel, the device comprising at least one attachment surface able to allow the attachment of the device to the hull, wherein the device includes a plurality of permanent magnets arranged in the vicinity of the attachment surface in order to attach the device to the hull, wherein the hull defines an outer surface of the marine vessel and tightly separates an inner space of the marine vessel from an outer space outside of the marine vessel, including when the hull is under an effect of outside pressures, and wherein the device comprises a tile of elastomer material that, with the tile attached to the hull, forms a coating of at least part of the hull, said at least part of the hull being an outer surface of the hull, and wherein the tile has at least one beveled edge suitable for cooperating with a nonslip rib extending over the outer surface of the hull.

2. The hull device according to claim 1, wherein the magnets are positioned in a grid on the attachment surface, each magnet being adjacent to or in the vicinity of at least one closest neighbor, each magnet having a polarity, the polarity of each magnet being oriented in the direction opposite the polarity of its at least one closest neighbor.

3. The hull device according to claim 2, wherein the grid forms a checkerboard, each magnet being adjacent to between one and four closest neighbors.

4. The hull device according to claim 1, wherein the magnets are embedded in the tile in the vicinity of the attachment surface.

5. The hull device according to claim 1, wherein the attachment surface includes an inner region extending away from the edges of the tile and a peripheral region surrounding the inner region and extending near the edges of the tile, the magnets being positioned on at least part of the peripheral region of the attachment surface, the inner region of the attachment surface being devoid of magnets.

6. A marine vessel provided with the hull device according to claim 1, the device being reversibly attached on the outer surface of the hull of the marine vessel, the attachment surface being positioned against the hull in a below-waterline position, the attachment of the device to the hull being done by the plurality of magnets.

7. The hull device according to claim 4, wherein the attachment surface includes an inner region extending away from the edges of the tile and a peripheral region surrounding the inner region and extending near the edges of the tile, the magnets being positioned on at least part of the peripheral region of the attachment surface, the inner region of the attachment surface being devoid of magnets.

8. The hull device according to claim 1, wherein the tile is a plate fixed to the outer surface of the hull.

9. The hull device according to claim 1, wherein the magnets are embedded in the tile flush with the attachment surface.

10. The hull device according to claim 9, wherein the attachment surface includes an inner region extending away from the edges of the tile and a peripheral region surrounding the inner region and extending near the edges of the tile, the magnets being positioned on at least part of the peripheral region of the attachment surface, the inner region of the attachment surface being devoid of magnets.

11. The hull device according to claim 1, wherein the tile provides the attachment surface and the magnets are positioned on or embedded in the attachment surface.

12. The hull device according to claim 1, wherein the elastomer material that forms the coating of at least part of the hull forms an anechoic coating on the at least part of the hull.

13. A marine vessel provided with a plurality of hull devices, suitable for being reversibly fastened on an outer surface of a hull made from a ferromagnetic material of a marine vessel, each hull device comprising at least one attachment surface able to allow the attachment of each hull device to the hull, wherein each hull device includes a plurality of permanent magnets arranged in the vicinity of the attachment surface in order to attach each said device to the hull, wherein the hull defines an outer surface of the marine vessel and tightly separates an inner space of the marine vessel from an outer space outside of the marine vessel, including when the hull is under an effect of outside pressures, and wherein each hull device comprises a tile of elastomer material that, with the tile attached to the hull, forms a coating of at least part of the hull, said at least part of the hull being an outer surface of the hull, the plural hull devices being reversibly attached on the outer surface of the hull of the marine vessel adjacent each other against the hull in a below-waterline position, wherein each tile is a plate fixed to the outer surface of the hull, and the attachment of each of the plural devices to the hull being done by the plurality of magnets.

* * * * *